US009532633B1

(12) United States Patent
Tan et al.

(10) Patent No.: US 9,532,633 B1
(45) Date of Patent: Jan. 3, 2017

(54) PROTECTIVE COVER WITH LOCK-IN DESIGN

(71) Applicants: Chee K. Tan, Atlanta, GA (US); Yannie K. Tan, Atlanta, GA (US)

(72) Inventors: Chee K. Tan, Atlanta, GA (US); Yannie K. Tan, Atlanta, GA (US)

( * ) Notice: Subject to any disclaimer, the term of this patent is extended or adjusted under 35 U.S.C. 154(b) by 0 days.

(21) Appl. No.: 14/604,921

(22) Filed: Jan. 26, 2015

(51) Int. Cl.
*B65D 85/00* (2006.01)
*A45C 13/08* (2006.01)

(52) U.S. Cl.
CPC ..... *A45C 13/08* (2013.01)

(58) Field of Classification Search
CPC ..... A45C 3/06; A45C 3/08; A45C 3/00; A45C 13/02; A45C 13/04
USPC 150/100, 103, 104, 105, 106, 108; 379/451, 437; 206/320, 459.5; D14/250
See application file for complete search history.

(56) References Cited

U.S. PATENT DOCUMENTS

| | | | | |
|---|---|---|---|---|
| 3,604,145 | A | 9/1971 | Zimmerman | |
| 3,895,456 | A | 7/1975 | Fabre | |
| 4,107,870 | A | 8/1978 | Ausnit | |
| 5,852,829 | A | 12/1998 | Relaford | |
| D537,063 | S | 2/2007 | Kim et al. | |
| 8,240,010 | B2 | 8/2012 | O'Donnell | |
| 8,540,544 | B1 | 9/2013 | Logue | |
| 8,676,281 | B1 | 3/2014 | Caulder et al. | |
| 8,813,402 | B2 | 8/2014 | Ponce | |
| 2009/0056167 | A1 | 3/2009 | Sanguinetti | |
| 2009/0107021 | A1 | 4/2009 | Koeppel | |
| 2009/0118012 | A1* | 5/2009 | Sternberg | A63H 33/04 463/37 |
| 2009/0323296 | A1 | 12/2009 | Sanzone | |
| 2010/0096284 | A1* | 4/2010 | Bau | B65D 85/00 206/320 |
| 2010/0252152 | A1 | 10/2010 | Stupski | |
| 2012/0261289 | A1* | 10/2012 | Wyner | A45C 11/00 206/320 |
| 2012/0274195 | A1* | 11/2012 | Thompson | H04M 1/0283 312/237 |
| 2013/0063874 | A1* | 3/2013 | Yi | H04M 1/0283 361/679.01 |

(Continued)

FOREIGN PATENT DOCUMENTS

| | | |
|---|---|---|
| CH | 613741 | 10/1979 |
| EP | 0506354 | 9/1992 |
| GB | 2184862 | 7/1987 |

OTHER PUBLICATIONS www.pixelbags.com, last accessed Sep. 10, 2015.

*Primary Examiner* — Fenn Mathew
*Assistant Examiner* — Cynthia Collado
(74) *Attorney, Agent, or Firm* — Sutherland Asbill & Brennan LLP

(57) ABSTRACT

The present invention is a cover system for a device that includes a base with outer and inner surfaces. The outer surface includes a plurality of polygonal recesses, each having a bottom and a plurality of side walls with wall surfaces. Each one of the polygonal recesses has at least one wall in common with at least one other recess. The invention also includes one or more polygonal inserts with, each polygonal insert having a cap with two sides and a first stem extending from one side of the cap. The stem is shaped to form a friction fit when inserted into a recess. Some stems may include an o-ring that fits into a groove extending along all wall surface of a recess.

18 Claims, 12 Drawing Sheets

(56) References Cited

U.S. PATENT DOCUMENTS

| | | | | |
|---|---|---|---|---|
| 2013/0118932 | A1* | 5/2013 | Green ..... | A45C 11/00<br>206/320 |
| 2013/0344769 | A1 | 12/2013 | Thompson et al. | |
| 2014/0045557 | A1 | 2/2014 | Chung | |
| 2014/0112652 | A1 | 4/2014 | Latto et al. | |

* cited by examiner

PROTECTIVE COVER WITH LOCK-IN DESIGN

FIELD OF THE INVENTION

The field of the invention is related to the field of device covers, particularly the field of decorative covers, and more particularly, the field of changeable device covers.

BACKGROUND OF THE INVENTION

Covers have been used to protect devices of all types including electronic devices. While protection from damage from drops, weather, etc. is important, the wide spread use of covers has inevitably led to the use of covers for decoration as well as protection.

Most cover decorations are printed onto one or both sides of the cover using digital processes, silkscreen techniques, injection molding infusion, decals, or other permanent decorations, and thus are permanent. While permanent decorations are useful, for example, for corporate and school names, logos, artistic designs, titles, etc., temporary decorations allow users, such as school children, device companies, and toy companies to create their own covers, use them for a period of time, and change the decoration to a new design.

U.S. Pat. No. 8,676,281 to Caulder, et al. discloses a cell phone cover system in which a transparent cover is snap-fit over the back of a cell phone or other device with a decorative card placed between the cell phone and the cover. This system does not allow for the creative development of unique designs or decorations only the use of decorations supplied with the system. U.S. Pat. No. 8,240,010 to O'Donnell discloses a money clip having interchangeable covers for displaying engravings such as logos, pictures, etc. on a gripping surface. This only provides for a single permanent decoration for the money clip.

Clearly then, there is a need in the field for a cover system that allows for decorative device covers providing components that enable the user to change the decorations at any time to create new and unique "one of a kind" designs.

SUMMARY OF THE INVENTION

The present invention broadly comprises a cover system for a device comprising: a base having on outer surface and an inner surface, wherein the outer surface includes a plurality of polygonal recesses, each of the plurality of polygonal recesses having a bottom and a plurality of side walls; wherein each side of the plurality of side walls has forms a wall surface; wherein each of the plurality of polygonal recesses has at least one wall in common with at least one other of the plurality of polygonal recesses; and, at least one polygonal insert, each of the at least one polygonal inserts having: a cap with two opposing sides; and, a first stem extending from a first side of the cap, wherein the stem is shaped to fit nestingly into one of the polygonal recesses; and, wherein the inner surface faces a surface of a device covered by the cover system.

In one embodiment, an o-ring is placed around the insert stem and fits into a groove extending around the wall surfaces of the recess receiving the insert.

In a second embodiment, the insert includes a second stem extending from the cap in an opposite direction the first stem.

One object of the invention is to provide a device cover that allows for multiple decorative patterns.

A second object of the invention is to supply a cover with a stretch fit over a device.

An additional object of the invention is to present a pliant cover with energy absorbing properties.

A further object of the invention is present a cover that may be used with flexible items such as bags, backpacks, and purses.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
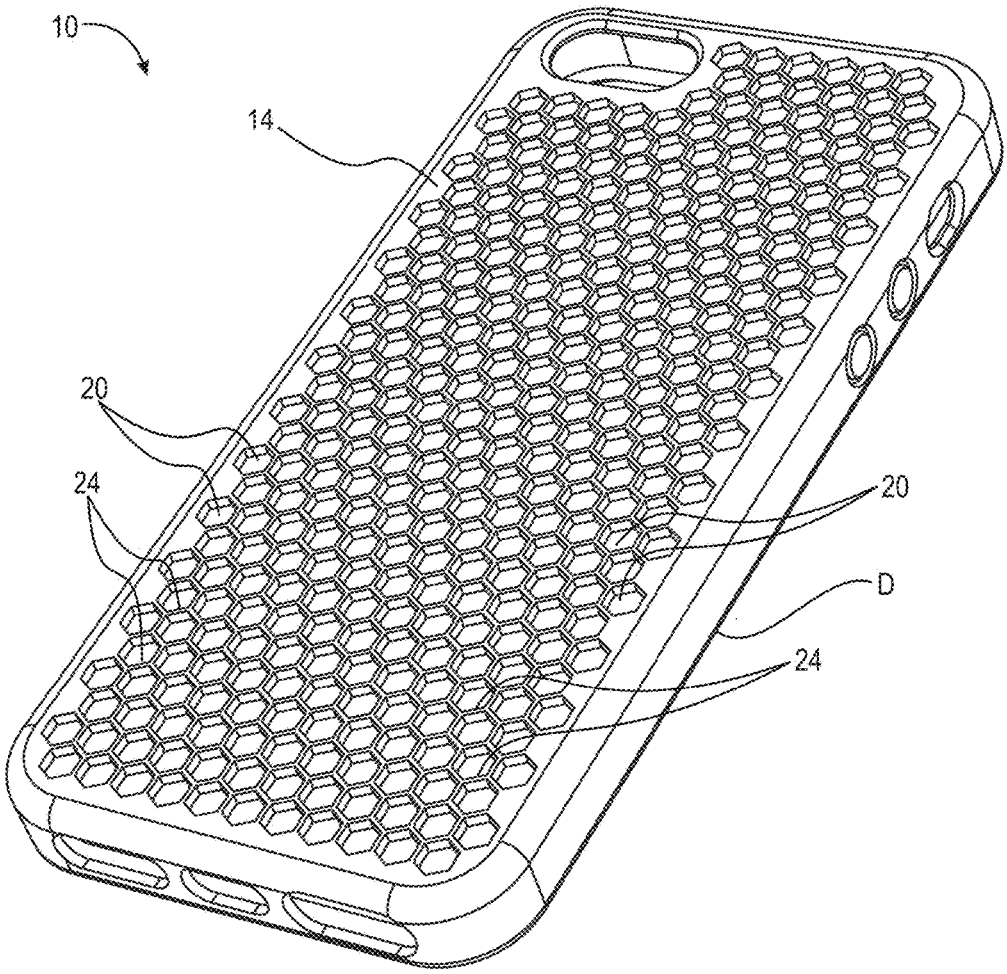
FIG. 1 is a top perspective view of a device with the back side of the device covered by the cover of the present invention.

FIG. 1 is a top perspective view of a device D, in the present example an IPHONE®, with the back side covered by cover 10 of the present invention. Cover 10 includes a base having an inner surface 12 (not shown in FIG. 1), and outer surface 14. Outer surface 14 includes a plurality of polygonal recesses 20. In FIG. 1, recesses are distributed through the entire or almost the entire area of outer surface 14. In alternate embodiments, spaces may be found on outer surface 14 in which recesses 20 are missing.

Figure 2:
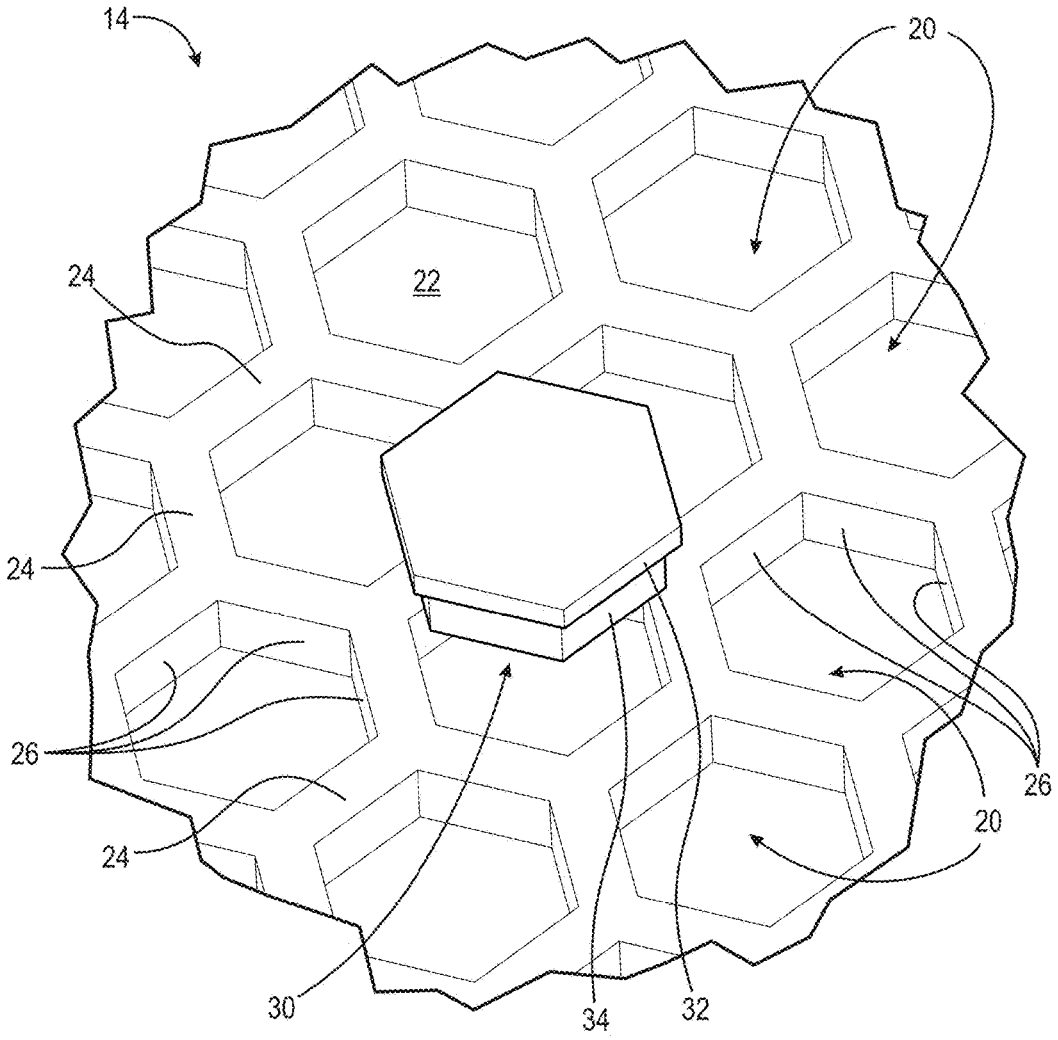
FIG. 2 is an enlarged view of several of recesses seen originally in FIG. 1.

FIG. 2 is an enlarged view of several of recesses 20 seen originally in FIG. 1. Each recess 20 includes continuous bottom surface 22 and a plurality of side walls 24 ("wall 24"). It can be seen in FIGS. 1 and 2 that at least one wall 24 of a recess 20 is common to two or more different recesses 20. By common is meant that a particular wall 24 forms a wall for two adjacent recesses 20. Walls 24 have wall surfaces 26 that extend perpendicularly from bottom surface 22. Bottom surface 22 is in continuous contact with each of side walls 24 that form each of the recesses 20.

Figure 3:
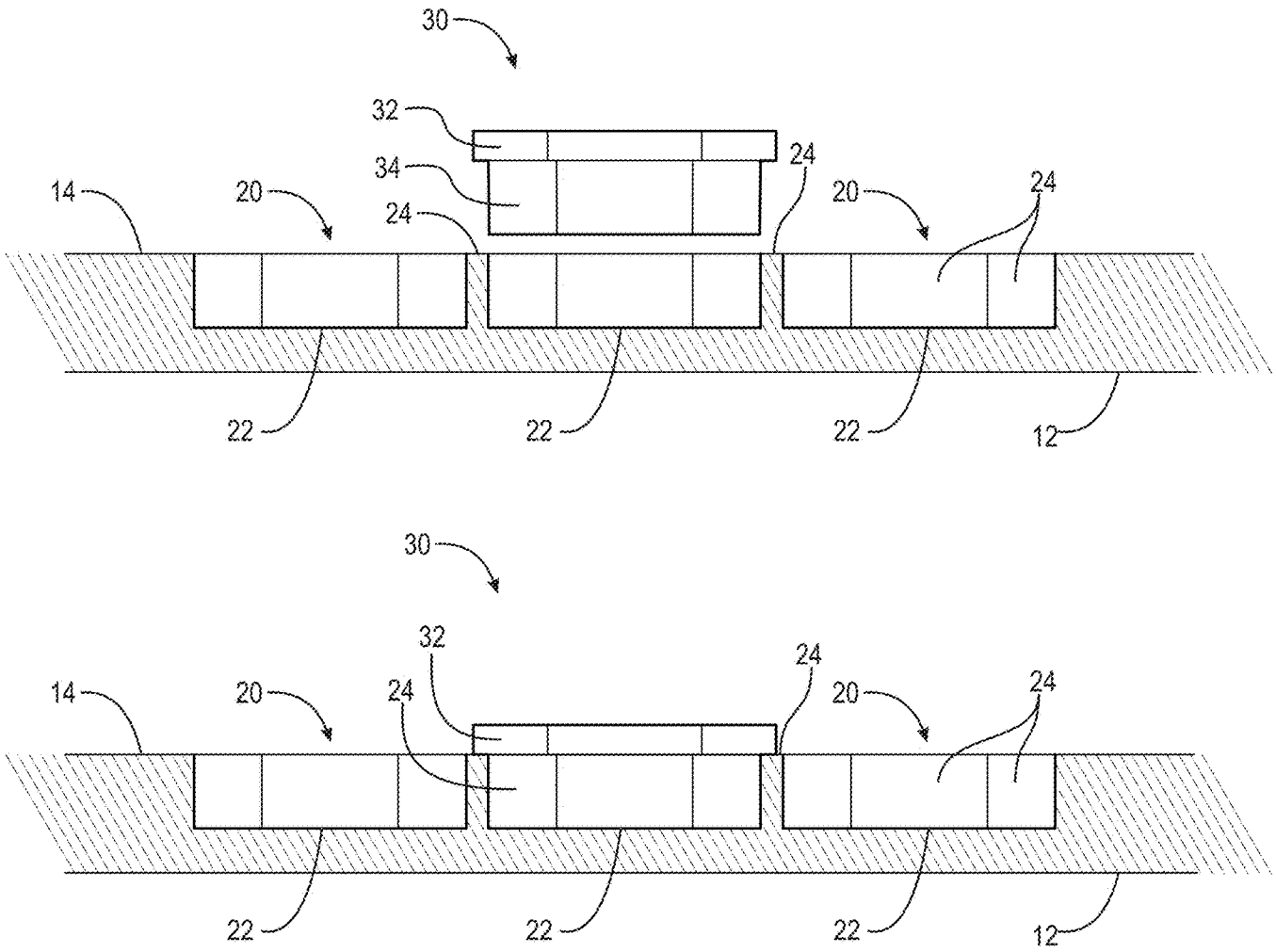
FIG. 3 is a side view showing the positioning of the insert into the recess.

Also seen in FIG. 2 is polygonal insert 30 ("insert 30"). Insert 30 comprises polygonal cap 32 having two opposing sides and polygonal stem 34 which extends from one side of cap 32. Preferably, stem 34 has the same polygonal shape as the continuous walls of recess 20. More preferably, cap 32 is shaped into the same polygonal shape as recess 20 and stem 34, but is larger in area. FIG. 3 is a side view showing the insertion of insert 30 into recess 20. It can be seen that stem 34 of insert 30 is sized to fit nestingly with a friction fit into recess 20. Also seen is bottom surface 12 of cover 10. Placement of insert 30 may be permanent or temporary.

Figure 4:
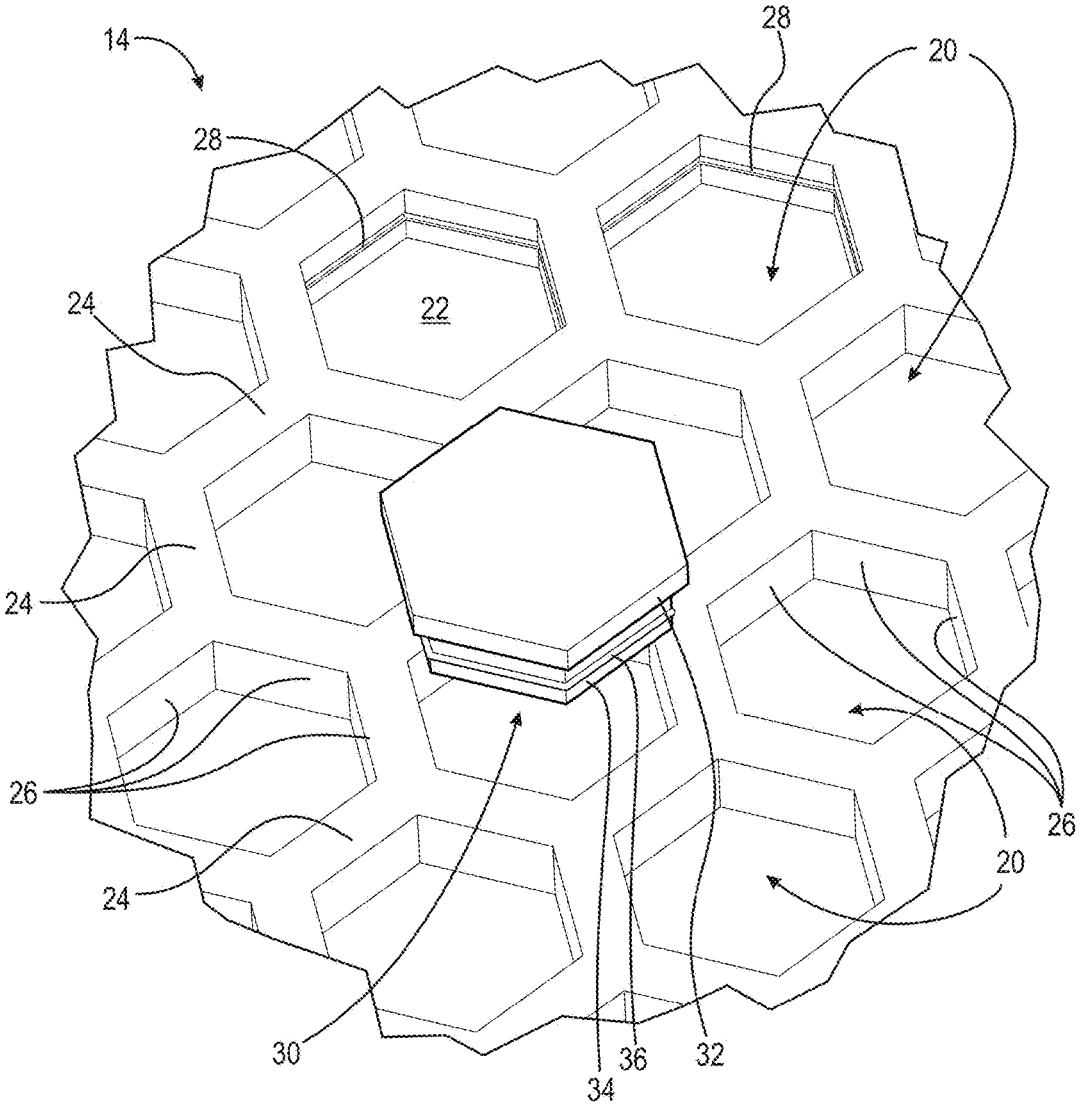
FIG. 4 is an enlarged view of several recesses depicting an alternate embodiment of the insert and the recess.
Figure 5:
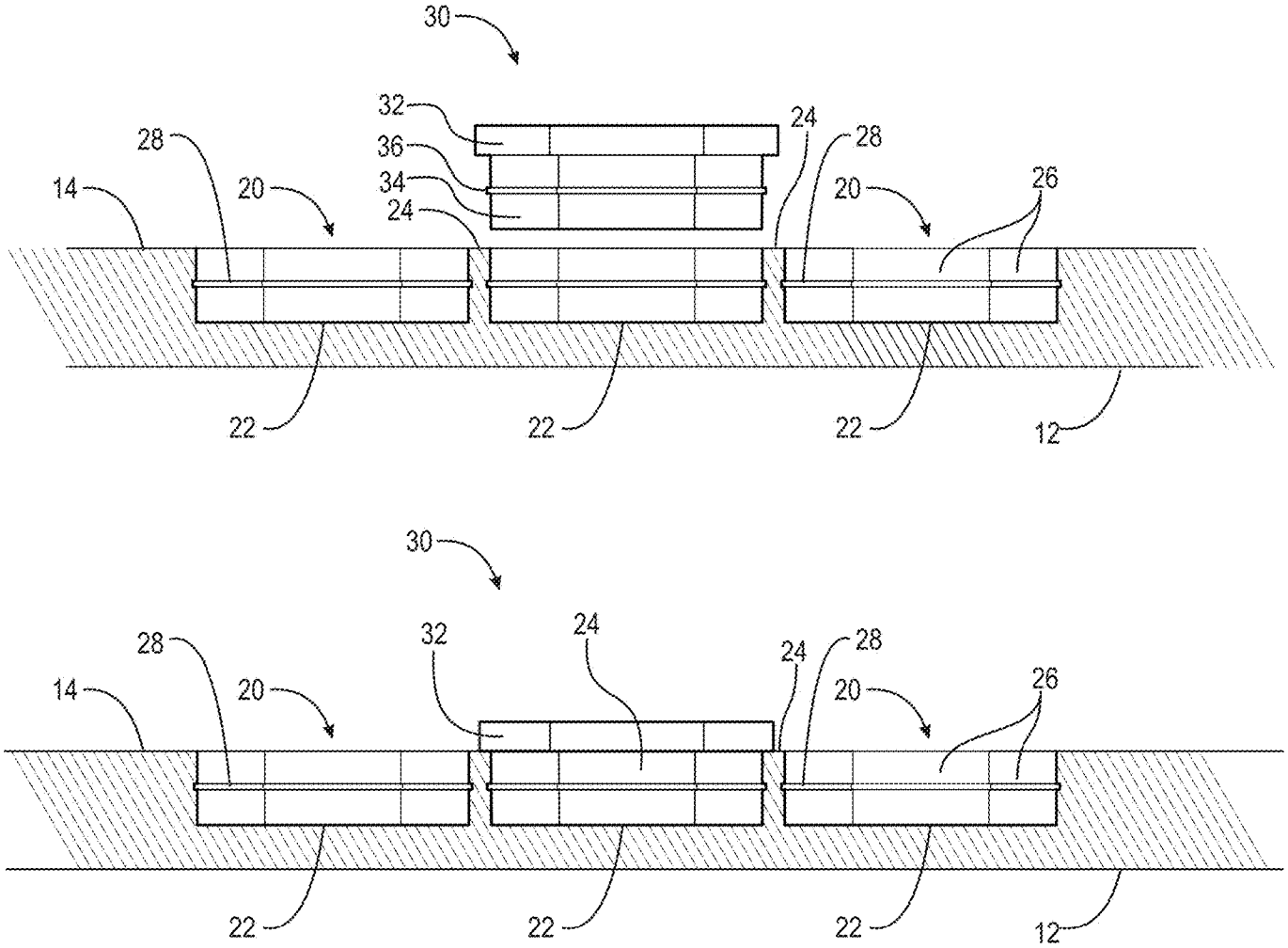
FIG. 5 is a side view showing the insertion of the insert with an o-ring into the recess.

FIG. 4 is an enlarged view of several recesses depicting an alternate embodiment of insert 30 and recess 20. O-ring 36 is positioned around stem 34. O-ring 36 may be held in place by placing it within a groove in stem 34, or by adhesives, or other means known to those skilled in the art. Also seen is groove 28 etched, machined, molded, or otherwise set into each wall surface 26 of recess 20. As seen in FIG. 4, in some embodiments of outer surface 14, some but not all recesses 20 may include groove 28. In other embodiments, groove 28 may be present in all recesses 20 on surface 14. FIG. 5 is a side view showing the insertion of insert 30 with o-ring 36 into recess 20. It can be seen that stem 34 of insert 30 is sized to fit nestingly with a friction fit into recess 20 with o-ring 36 fitting into groove 28. The embodiment seen in FIGS. 4 and 5 may allow for a permanent or temporary placement of insert 30 into recess 20.

Figure 6:
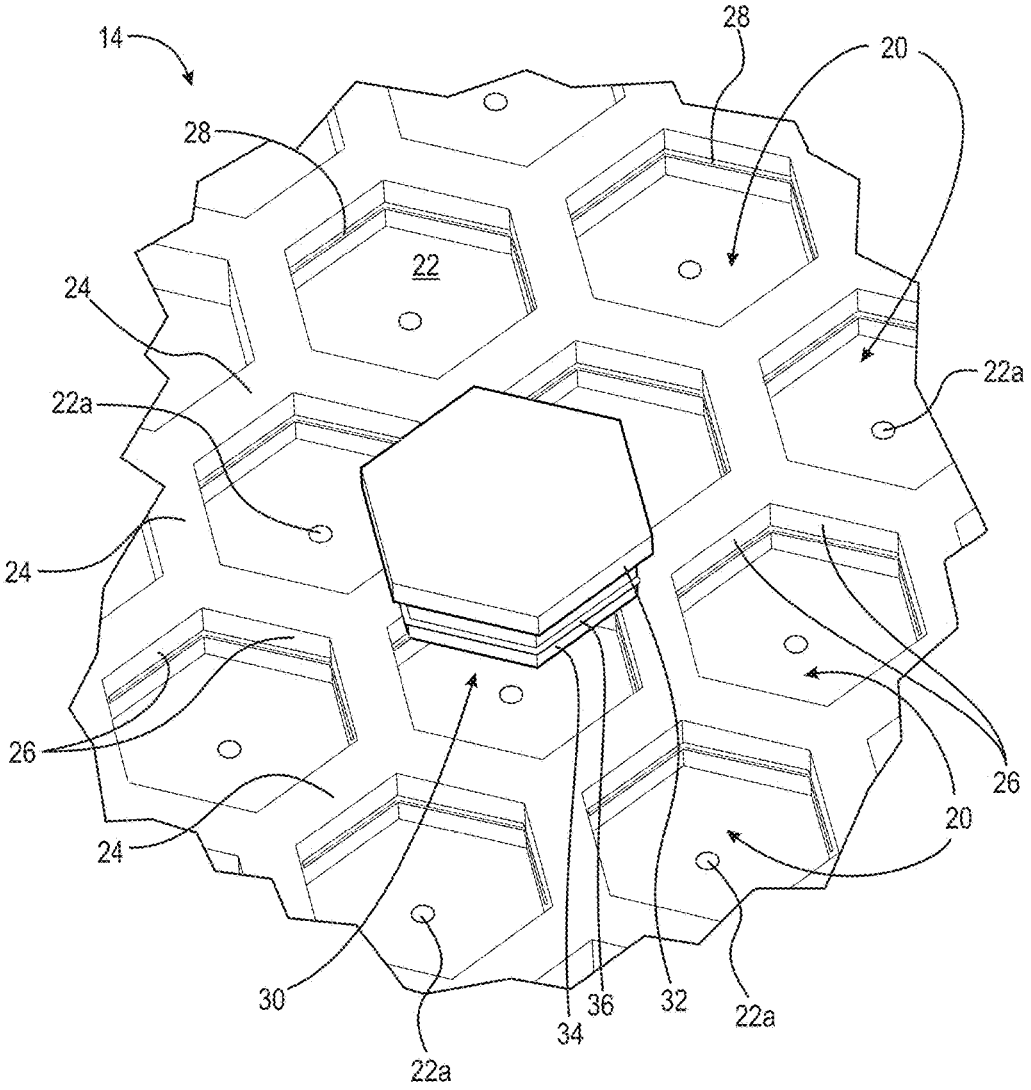
FIG. 6 is an enlarged view of the outer surface of the cover in which each of the bottom surfaces of the recesses defines an orifice.

FIG. 6 is an enlarged view of surface 14 depicting an additional alternate embodiment of cover 10. Orifice 22*a* is defined by bottom surface 22. As discussed below, insert 30 preferably may be transparent or translucent. Also seen in FIG. 6 is the embodiment is which groove 28 extends around wall surfaces 26 of each recess 20.

Figure 7:
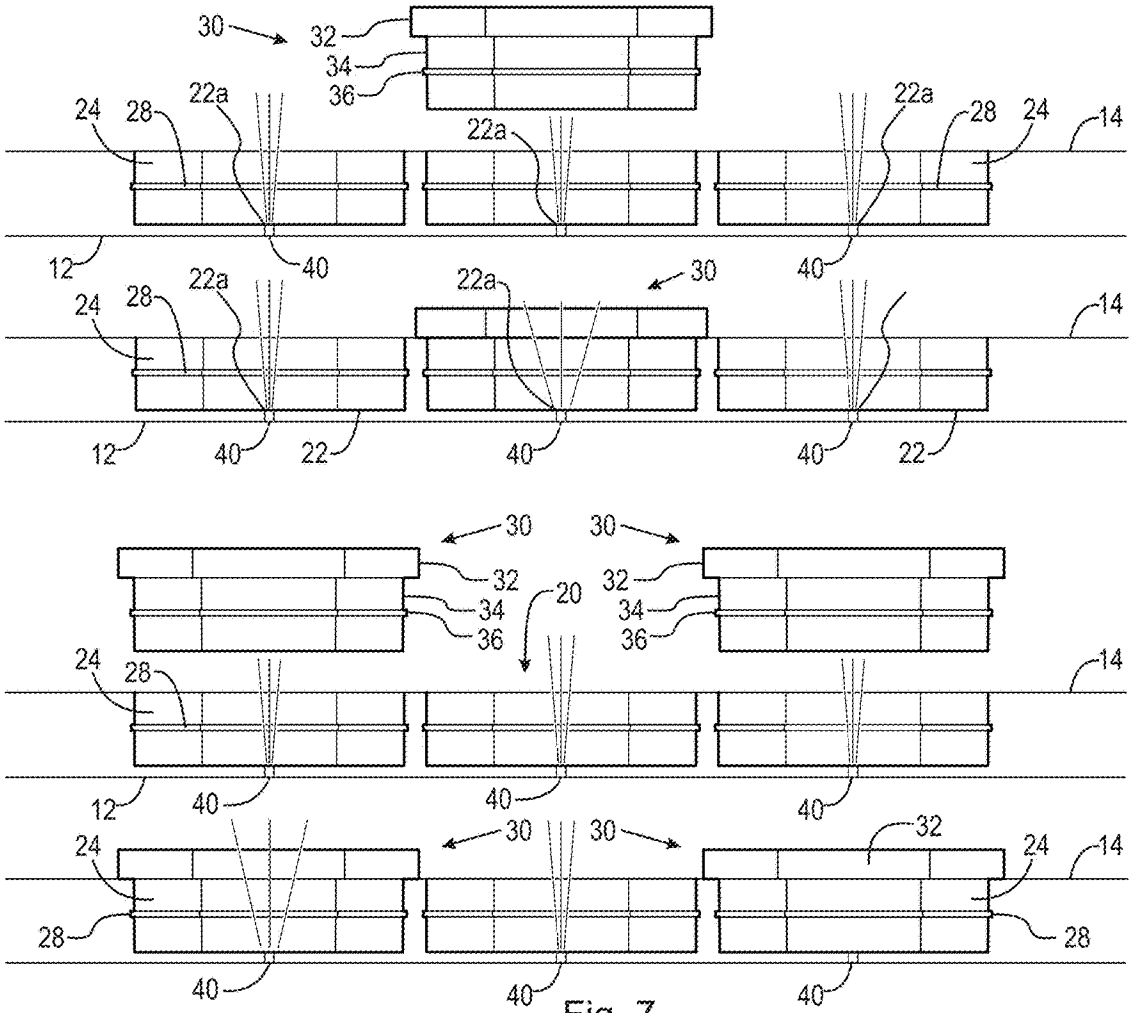
FIG. 7 is a side view of the cover of the present invention depicting the orifices defined by the bottom surfaces of the recesses showing a light source emitting light through the orifices.

FIG. 7 is a side view of cover 10 depicting orifices 22*a* in which light from light source(s) 40 on device D or bottom surface 12 is emitted through orifices 22*a*. In the top two representations, insert 30*a* is placed into recess 20. Insert 30*a* is either transparent or translucent enabling the light from light source 40 to pass through insert 30*a* to be seen outside surface 14. Insert 30*a* may be clear or may be colored to allow the light passing through inserts 30*a* to create colored patterns of light.

The bottom two representations depict the embodiment in which both insert 30*a* and opaque insert 30 are used in the same cover 10. In this embodiment, light from source 40 can be blocked from passing through insert 30. By using both inserts 30 and 30*a* additional patterns of light passing through surface 14 can be created. It should be recognized that inserts 30 and 30*a* that do not have o-rings 36 may also be used. In addition, recesses 20 may not include grooves 28. Inserts 30 and 30*a* may be places either permanently or temporarily into recesses 20.

Figure 8:
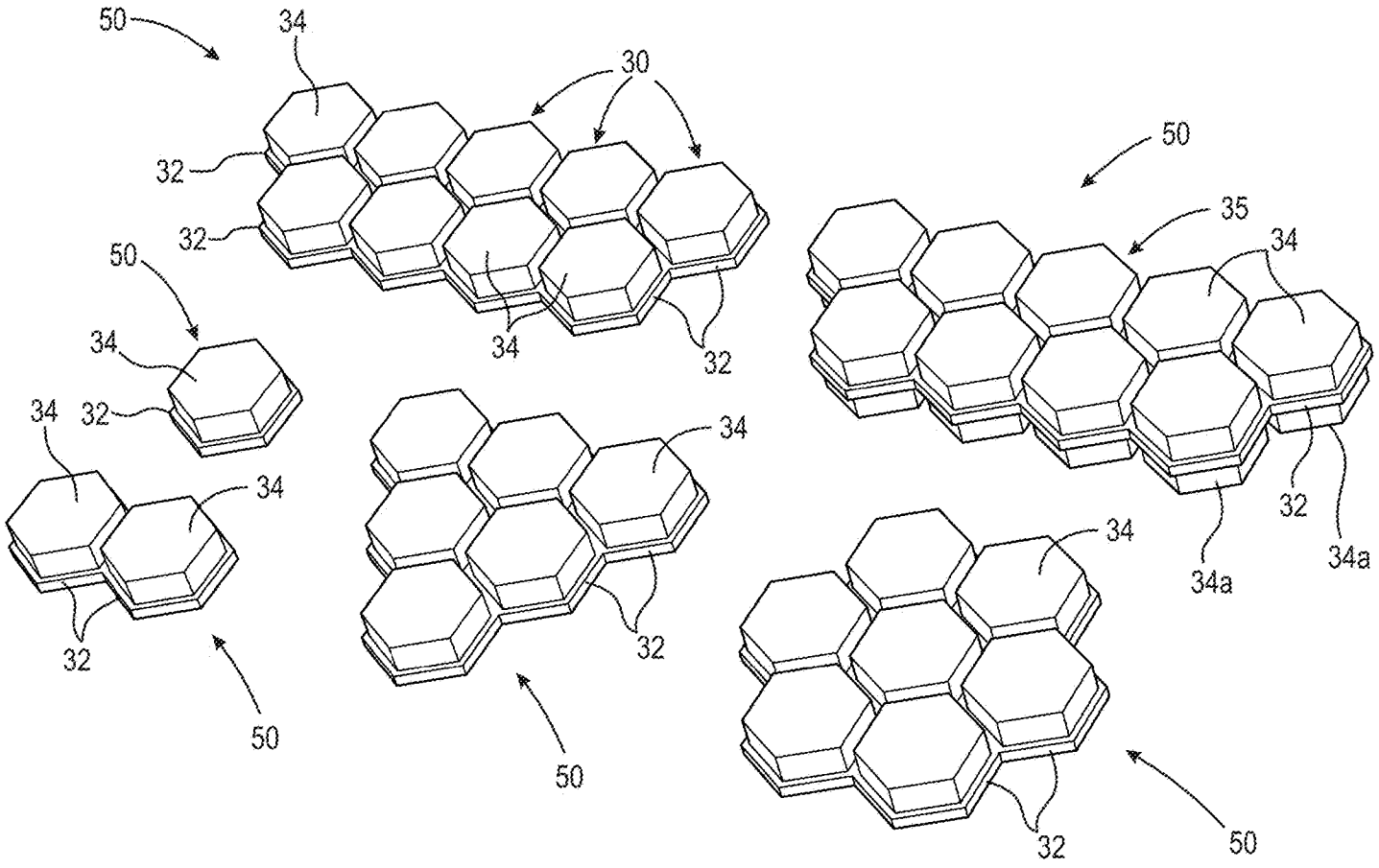
FIG. 8 is a bottom perspective view of additional embodiments of the present invention in which a plurality of individual inserts are joined together to form a single unit.

FIG. 8 is a bottom perspective view of additional embodiments of the present invention in which a plurality of inserts 30 and 30*a* are joined together to from a single insert block 50. Caps 32 of each insert 30 are joined together to form a single integral unit or block. Blocks 50 can have any number of inserts 30 joined to form a single block 50. As can be seen in FIG. 8, block 50 can have any shape. Inserts 30 may be joined using methods known to hose having skill in the art.

Figure 9:
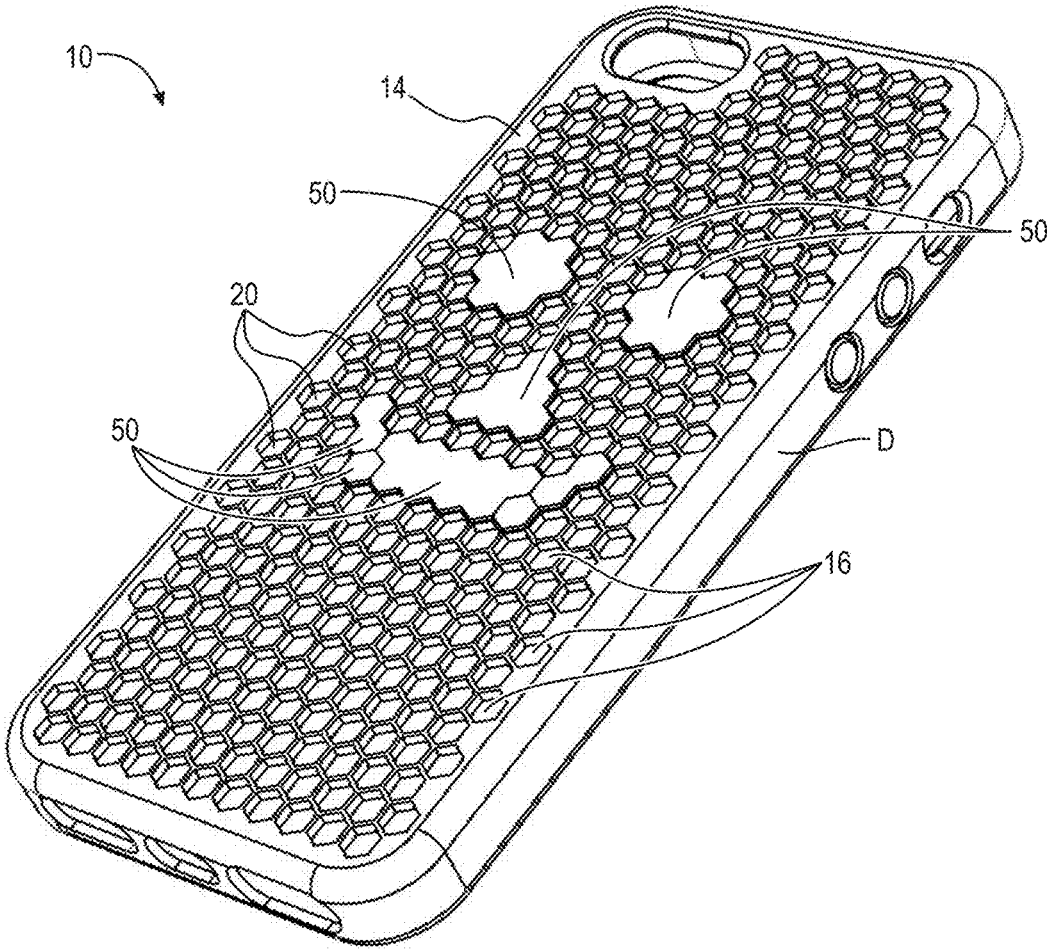
FIG. 9 depicts a different embodiment of the cover of the present invention showing the placement of joined inserts into adjacent recesses.

FIG. 8 also depicts block 52 in which inserts 35 are joined at cap 32 to form the block. Insert 35 has a second stem 34*a* extending from cap 32 in the opposite direction from stem 34. Insert 35 and block 52 provide a "rough" feel and appearance to cover 10 as opposed to the smooth feel and appearance of flat cap 32 or block 50. Inserts 35 and block 52 provide an advantage over products manufactured with similar inserts in which a "rough feel" insert is fitted over a stem extending from the cover surface rather than into a recess in that such inserts are more easily rubbed off the surface of the cover. FIG. 9 is a top perspective view of cover 10 fit over device D. Blocks 50 of various shapes are seen inserted into recesses 20 to form diverse decorative shapes on surface 14 of cover 10.

Figure 10A:
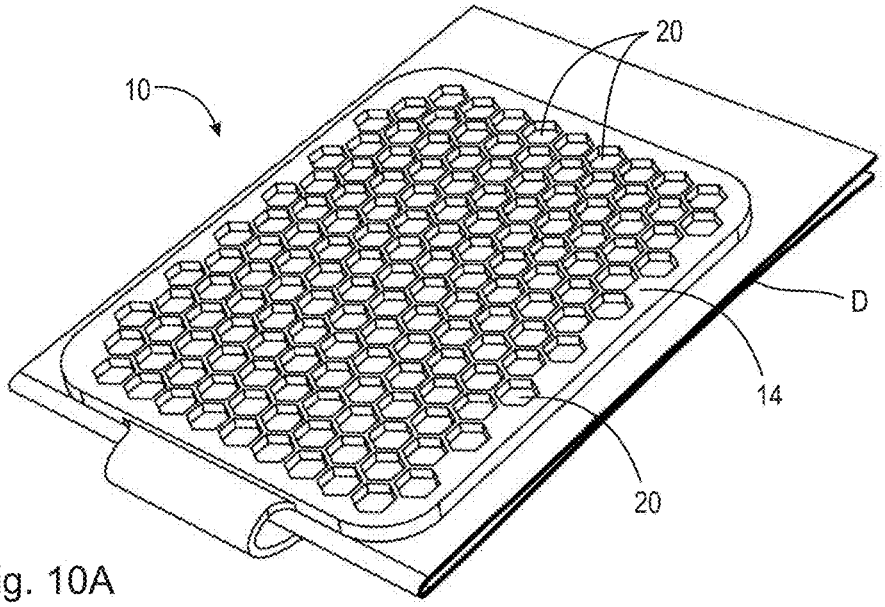
FIGS. 10A and 10B provide additional examples of devices that can be protected with the cover of the present invention.
Figure 10B:
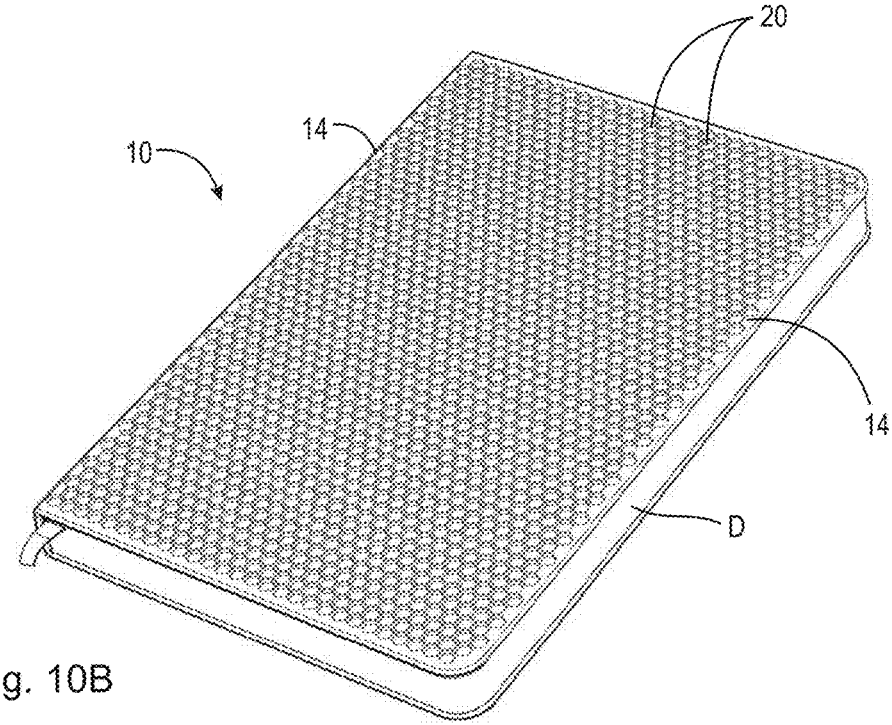

FIGS. 10A and 10B provide additional examples, a money clip and a tablet, respectively, of devices D that can be protected with cover 10.

Figure 11:
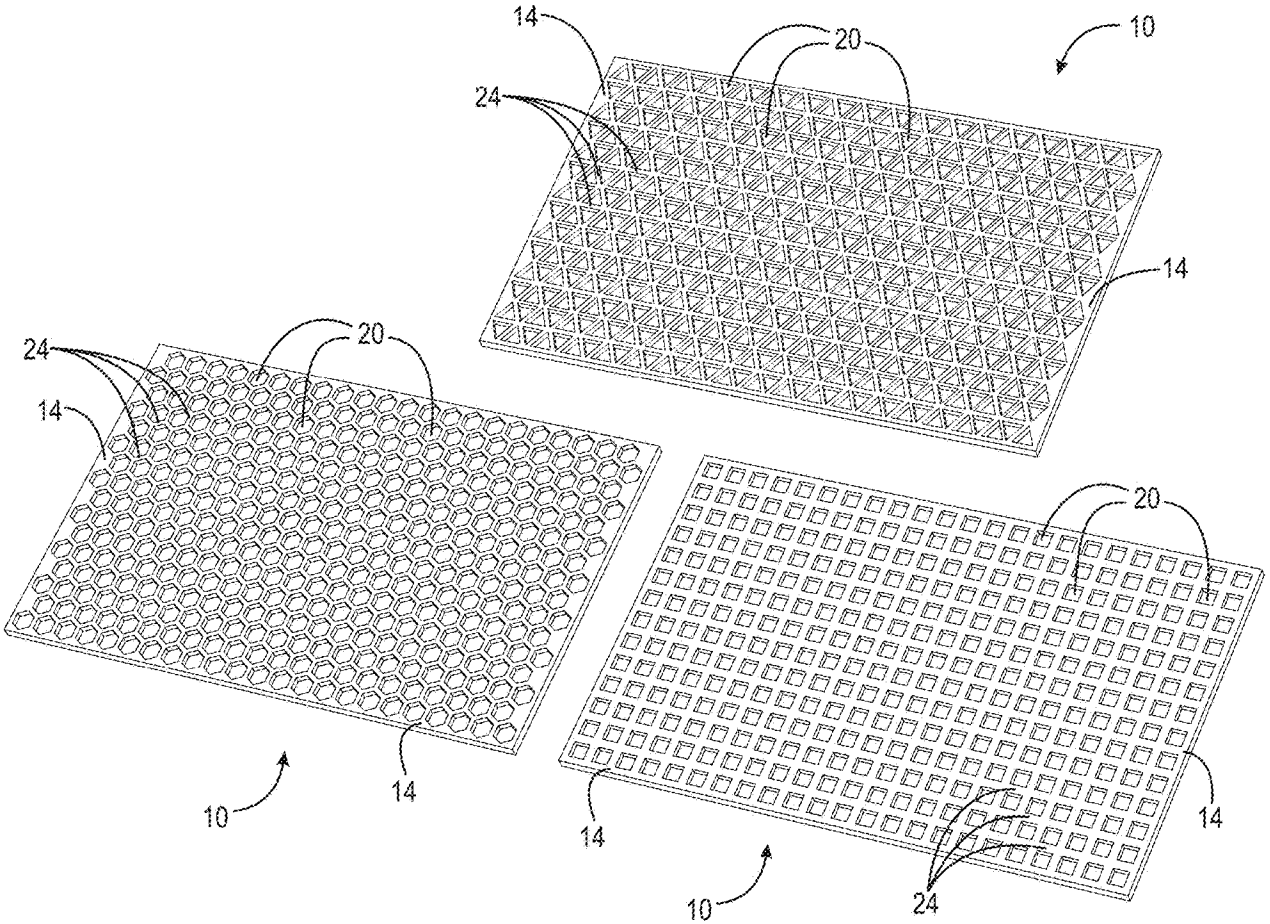
FIG. 11 depicts different shapes for polygonal recesses in the cover of the present invention.

FIG. 11 depicts three different arrangements for recesses 20 in cover 10. It can be seen that polygonal shapes such as squares, hexagons, triangles, etc. may be arranged as recesses 20 each having walls 24 common with adjacent recesses. Recesses 20 located at the edges of surface 14 will have at least one wall in common with an adjacent recess 20 located away from the edge of surface 14.

Figure 12:
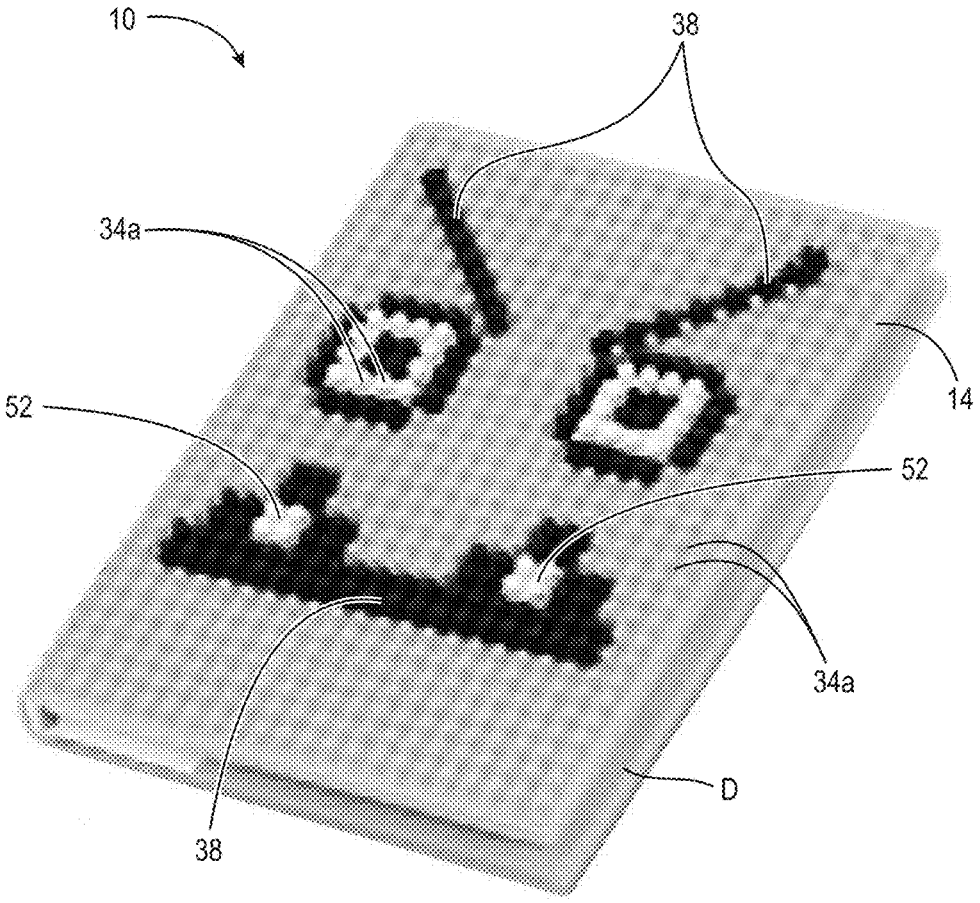
FIG. 12 is a top perspective view of the cover in which inserts and blocks with extended stems are inserted into recess in the outer surface to create a rough surface.

FIG. 12 is a top perspective view of cover 10 in which inserts 35 and block 52 are inserted into each recess 20 of cover 10. The extended second stem 34*a* in inserts 35 and block 52 creates a rough surface rather than the smooth surface seen with block 50 or individual inserts 30. Spaces 38 are areas in surface 14 in which no inserts or blocks are placed. FIG. 12 also demonstrates how inserts and surfaces of different colors can be used to create decorative patterns in on cover 10. Blocks 50 and 52 may be shaped complementarily to fit nestingly with a friction fit into spaces 38

Inserts 30 and 35 and blocks 50 and 52, along with surface 14 with recesses 20 may be fabricated with rigid plastics such as polyethylene or preferably with more pliant and flexible materials such as, for example, silicon and liquid silicon rubber. Inserts 30 and 35 as well as blocks 50 and 52 are held in recesses 20 with a friction fit with the male stem 34 fitting into the female recess 20. Cover 10 can be made from pliant materials, shaped appropriately and stretched over a particular device D to attach to device D with tension created by stretching over a particular device D. The pliant material possesses energy absorbing or dampening properties providing the advantage absorbing the force of drops and also supplying a soft gripping surface for the user.

It will be recognized that the cover system may also be used on such devices as pencil cases, tissue boxes, and other items with hard surfaces. Bottom surface 12 of cover 10 may be attached to hard surfaces with "peel and stick" and other adhesives, hook and loop attachments (VELCRO®), and other attachment devices and methods known to those having skill in the art. Cover 10 may also be attached to flexible articles such as purses, backpacks, gym bags, using appropriate adhesives, hook and loop attachments, rivets, and other attachment components and systems known to those having skill in the art. Finally, a second cover, which can be transparent, may be fit over cover 10 using a snap fit or a friction fit.

Thus it is seen that the objects of the invention are efficiently obtained, although changes and modifications to the invention should be readily apparent to those having ordinary skill in the art, which changes would not depart from the spirit and scope of the invention as claimed.

We claim:

1. A cover system for a device comprising:

a one-piece base having on outer surface and an inner surface, wherein said outer surface includes a plurality of polygonal recesses, each of said plurality of polygonal recesses having a continuous bottom surface and a plurality of side walls;

wherein said continuous bottom surface is in continuous contact with each one of said plurality of side walls;

wherein each side of said plurality of side walls includes a wall surface;

wherein each of said plurality of polygonal recesses has at least one side wall in common with at least one other of said plurality of polygonal recesses; and, at least one polygonal insert, each of said at least one polygonal inserts having:

a cap having two opposing sides; and, a first stem extending from a first side of said cap, wherein said stem is shaped to fit nestingly into one of said polygonal recesses;

wherein said inner surface faces a surface of a device covered by said cover system.

2. The cover system for a device as recited in claim 1 wherein at least one of said at least one inserts includes an o-ring positioned around said first stem.

3. The cover system for a device as recited in claim 1 wherein at least one recess of said plurality of recesses includes a continuous groove around each of said wall surfaces.

4. The cover system for a device as recited in claim 1 wherein at least one of said at least one inserts includes an o-ring positioned around said first stem and wherein at least one recess of said plurality of recesses includes a continuous groove around each of said wall surfaces.

5. The cover system for a device as recited in claim 1 wherein at least two of said caps are joined to form an integral unit.

6. The cover system for a device as recited in claim 5 such that the first stems of each of said at least two joined caps fit nestingly into adjacent polygonal recesses.

7. The cover system for a device as recited in claim 5 wherein said outer surface defines at least one space having a defined shape formed by said common walls; and, wherein said integral unit possesses a shape complementary to said at least one space; and, wherein said complementary shaped integral unit fits nestingly into said at least one defined shape.

8. The cover system for a device as recited in claim 7 wherein said nesting fit of said complementary shaped integral unit is temporary.

9. The cover system for a device as recited in claim 7 wherein said nesting fit of said complementary shaped integral unit is permanent.

10. The cover system for a device as recited in claim 1 wherein at least one of said inserts includes a second stem extending from a second side of said cap.

11. The cover system for a device as recited in claim 10 wherein said first stem includes an o-ring.

12. The cover system for a device as recited in claim 10 wherein said at least two of said caps are joined such that the first stems of each of said at least two joined caps fit nestingly into adjacent polygonal recesses.

13. The cover system for a device as recited in claim 1 wherein said bottom of at least one polygonal recess defined an orifice;

wherein at least one of said plurality of polygonal inserts is translucent or transparent;

wherein said at least one translucent or transparent polygonal insert fits nestingly into said at least one polygonal insert defining and orifice; and, wherein light from said device passes through said orifice and said at least one translucent or transparent polygonal insert.

14. The cover system for a device as recited in claim 13 wherein said at least one translucent or transparent insert is a plurality of translucent or transparent inserts.

15. The cover system for a device as recited in claim 13 wherein said at least one polygonal recess defining an orifice is a plurality of polygonal recesses defining an orifice.

16. The cover system for a device as recited in claim 1 further comprising a second cover arranged over said outer surface.

17. The cover system for a device as recited in claim 16 wherein said second cover is sized to fit nestingly over said base.

18. The cover system for a device as recited in claim 16 wherein said second cover is transparent or translucent.

* * * * *